US010596073B1

(12) United States Patent
Scherrer et al.

(10) Patent No.: US 10,596,073 B1
(45) Date of Patent: Mar. 24, 2020

(54) FEEDING BOTTLE

(71) Applicant: Mimijumi, LLC, Nashville, TN (US)

(72) Inventors: Lukas Scherrer, San Francisco, CA (US); Franklin J Drummond, Nashville, TN (US)

(73) Assignee: Mimijumi, LLC, Nashville, TN (US)

( * ) Notice: Subject to any disclaimer, the term of this patent is extended or adjusted under 35 U.S.C. 154(b) by 0 days.

(21) Appl. No.: 15/611,470

(22) Filed: Jun. 1, 2017

Related U.S. Application Data

(63) Continuation of application No. 13/301,373, filed on Nov. 21, 2011, now abandoned.

(60) Provisional application No. 61/416,048, filed on Nov. 22, 2010.

(51) Int. Cl.
*A61J 11/00* (2006.01)
*A61J 11/02* (2006.01)

(52) U.S. Cl.
CPC ..... *A61J 11/005* (2013.01); *A61J 11/02* (2013.01)

(58) Field of Classification Search
CPC ..... A61J 9/00; A61J 11/005; A61J 11/02
USPC ..... 215/11.1–11.6
See application file for complete search history.

(56) References Cited

U.S. PATENT DOCUMENTS

| | | | | |
|---|---|---|---|---|
| 156,549 | A | 11/1874 | Dickinson | |
| 921,387 | A | 5/1909 | Etter | |
| 1,099,082 | A | 6/1914 | More | |
| 1,146,639 | A | 7/1915 | Miller | |
| 1,683,246 | A | 9/1928 | Griffiths | |
| 1,998,646 | A | 4/1935 | Harold | |
| 1,999,581 | A | 4/1935 | Harold | |
| 2,090,749 | A | 8/1937 | Corsi et al. | |
| 2,196,870 | A | 4/1940 | Little | |
| 2,204,683 | A | 6/1940 | Lambert | |
| 2,426,927 | A | 9/1947 | Ganson | |
| 2,517,457 | A | 8/1950 | Adda | |
| 2,741,385 | A | 4/1956 | Raiche | |
| 2,834,496 | A | 5/1958 | Boston et al. | |
| 2,960,088 | A | 11/1960 | Witz | |
| 3,070,249 | A | 12/1962 | Schrwald | |
| 3,113,569 | A | 12/1963 | Barr et al. | |
| 4,505,398 | A | 3/1985 | Kesselring | |
| 4,613,050 | A * | 9/1986 | Atkin | A61J 9/00 215/11.5 |
| 4,765,497 | A | 8/1988 | Hsu | |

(Continued)

OTHER PUBLICATIONS

Office action for U.S. Appl. No. 13/301,373, dated Dec. 2016, Scherrer et al., "Feeding Bottle With One-Piece Nipple Assembly and Venting Membrane", 11 pages.

(Continued)

*Primary Examiner* — Anthony D Stashick
*Assistant Examiner* — Raven Collins
(74) *Attorney, Agent, or Firm* — Lee & Hayes, P.C.

(57) ABSTRACT

Apparatus and methods provide for a feeding bottle. According to embodiments described herein, a feeding bottle may include a container and a one-piece nipple assembly. The one-piece nipple assembly may include a ring substrate encompassed by a dome overmold with a nipple head. The nipple head and dome overmold may include a texture gradient and variable wall thickness to simulate a human breast. The interior of the nipple assembly 104 may additionally include an internal flow assist mechanism for assisting the fluid flow while the nipple head is bitten or pulled.

5 Claims, 9 Drawing Sheets

(56) References Cited

U.S. PATENT DOCUMENTS

D339,197 S 9/1993 Ziegler
5,269,426 A 12/1993 Morano
5,544,766 A 8/1996 Dunn et al.
D376,430 S 12/1996 Humphrey et al.
5,673,806 A 10/1997 Busnel
5,881,893 A 3/1999 Manganiello
5,993,479 A 11/1999 Prentiss
6,053,342 A * 4/2000 Chomik ..... A61J 9/04 215/11.1
D428,496 S 7/2000 Thom et al.
6,092,680 A 7/2000 Pillado
6,161,710 A 12/2000 Dieringer et al.
D444,239 S 6/2001 Kobayashi et al.
6,241,110 B1 6/2001 Hakim
6,253,935 B1 7/2001 Fletcher
D459,815 S 7/2002 Pastucha
D463,567 S 9/2002 Morano
6,446,822 B1 9/2002 Meyers et al.
D464,434 S 10/2002 Morano
D478,669 S 8/2003 Wear
6,601,720 B2 8/2003 Meyers et al.
6,645,228 B2 * 11/2003 Renz ..... A61J 11/0035 215/11.5
D486,579 S 2/2004 Dunn
6,745,912 B2 6/2004 Uehara et al.
6,871,751 B2 3/2005 Kerns et al.
6,883,672 B2 4/2005 Dunn et al.
6,957,744 B2 10/2005 Holley, Jr.
D511,385 S 11/2005 Lieberman et al.
6,991,122 B2 1/2006 Holley, Jr.
6,994,225 B2 2/2006 Hakim
7,122,045 B2 10/2006 Randolph et al.
7,134,564 B2 11/2006 Verbovszky
7,326,234 B2 2/2008 Lieberman et al.
D590,950 S 4/2009 Driver et al.
D595,417 S 6/2009 Driver et al.
D599,481 S 9/2009 Drummond
D599,482 S 9/2009 Drummond
7,637,382 B2 12/2009 Kraus et al.
7,712,617 B2 5/2010 Silver
D627,894 S 11/2010 Sirota et al.
D627,895 S 11/2010 Pheil et al.
7,866,495 B2 1/2011 Rohrig
7,928,178 B2 4/2011 Kerns et al.
D637,300 S 5/2011 Yamashita et al.
7,934,612 B1 5/2011 Mullen
8,016,142 B2 9/2011 Renz
D648,857 S 11/2011 Pheil et al.
8,172,874 B2 5/2012 Randolph et al.
8,181,800 B2 5/2012 Rees et al.
8,397,926 B2 3/2013 Driver et al.
8,448,796 B2 5/2013 Silver
8,567,619 B2 10/2013 Renz
8,573,436 B2 11/2013 Moore et al.
8,579,131 B2 11/2013 Greter et al.
8,657,135 B2 2/2014 Yamashita et al.
2003/0024895 A1 2/2003 Meyers et al.
2003/0089676 A1 5/2003 Uehara et al.
2003/0093121 A1 5/2003 Randolph
2004/0124168 A1 7/2004 Silver
2004/0144744 A1 7/2004 Holley
2004/0220618 A1 11/2004 Rohrig
2005/0035078 A1 2/2005 Lieberman et al.
2005/0056610 A1 * 3/2005 Randolph ..... A61J 9/001 215/11.1
2005/0056611 A1 3/2005 Hakim
2005/0184022 A1 8/2005 Dunn et al.
2005/0277987 A1 12/2005 Randolph et al.
2006/0011571 A1 * 1/2006 Silver ..... A61J 11/005 215/11.1
2006/0213858 A1 9/2006 Kraus et al.
2007/0068890 A1 3/2007 Rohrig
2007/0181520 A1 8/2007 Holley, Jr. et al.
2008/0128379 A1 6/2008 Hen
2008/0173612 A1 7/2008 Renz
2008/0210655 A1 9/2008 Rees et al.
2009/0039049 A1 2/2009 Horntrich et al.
2009/0139949 A1 6/2009 Py et al.
2009/0139950 A1 6/2009 Greter et al.
2009/0139995 A1 6/2009 Py et al.
2010/0108719 A1 5/2010 Py
2010/0193460 A1 8/2010 Driver et al.
2010/0316774 A1 12/2010 Py et al.
2011/0042339 A1 2/2011 Pfenniger et al.
2011/0114590 A1 * 5/2011 Ajmera ..... A61J 9/00 215/11.5
2011/0155684 A1 6/2011 Sirota
2011/0168714 A1 7/2011 Renz
2011/0303629 A1 12/2011 Wong
2012/0037587 A1 2/2012 Tirosh
2012/0152881 A1 6/2012 Py et al.
2012/0175335 A1 7/2012 Itzek et al.
2012/0267334 A1 10/2012 Yamashita et al.

OTHER PUBLICATIONS

Office action for U.S. Appl. No. 13/301,373, dated May 5, 2016, Scherrer et al., "Feeding Bottle With One-Piece Nipple Assembly and Venting Membrane", 10 pages.

* cited by examiner

FEEDING BOTTLE

CROSS-REFERENCE TO RELATED APPLICATIONS

This application is a continuation of co-pending U.S. patent application Ser. No. 13/301,373, filed Nov. 21, 2011, entitled "Feeding Bottle," which claims priority to U.S. Provisional Patent Application Ser. No. 61/416,048, filed on Nov. 22, 2010, both which are herein incorporated by reference in their entirety.

BACKGROUND

Many newborns and children in the early stages of life that are not breastfed are fed using a baby bottle. There are many types of bottles commonly used for feeding infants. Most baby bottles include a container for holding baby formula or other fluid and a synthetic nipple that is used to close the container and to allow for the baby to receive the fluid via a sucking action through a hole in the tip of the nipple. Conventional bottle nipples may include two pieces, a rubber or other pliable nipple portion to which the baby latches and sucks, and a rigid threaded ring piece used to secure the nipple portion to the container. The two-piece nipple design requires assembly when coupling the bottle nipple to the bottle. Moreover, the two-part nipple requires disassembly and separate cleaning of the parts after decoupling the nipple from the bottle.

The transition from breastfeeding to bottle feeding can be a challenging task. Conventional nipples commonly include a consistently smooth outside surface that does not adequately simulate a human breast. Many infants become accustomed to a human breast and are reluctant to latch onto a conventional bottle nipple. Additionally, typical baby bottle containers are generally cylindrical in shape with straight parallel walls that can easily slip out of a person's hand. Conventional bottles are also commonly manufactured from a type of plastic or similar material that easily slides over a typical counter or tabletop, which can frustrate an attempt to prepare the bottle with one hand while holding an infant with the other. While these features of conventional baby bottles result in a bottle that is capable of providing fluids to an infant, improvements that facilitate the preparation and use of the bottle by a person feeding an infant, as well as improvements that encourage latching on by an infant, are desirable.

It is with respect to these considerations and others that the disclosure made herein is presented.

SUMMARY

It should be appreciated that this Summary is provided to introduce a selection of concepts in a simplified form that are further described below in the Detailed Description. This Summary is not intended to be used to limit the scope of the claimed subject matter.

Apparatus and methods provide for a feeding bottle having a nipple that accurately simulates a human breast to encourage proper infant latching and feeding, while providing an ergonomic non-slip bottle that simplifies use and cleaning by a care provider. According to one aspect of the disclosure provided herein, a feeding bottle includes a container and a one-piece nipple assembly. The one-piece nipple assembly may include a rigid ring substrate that may be coupled to the container. The nipple assembly may also include a nipple head and a dome overmold, which are both pliable. The dome overmold encompasses and is bonded to the ring substrate to create the one-piece nipple assembly. An internal flow assist mechanism may be incorporated into an inside surface of the nipple head and the dome overmold. This mechanism is configured to allow fluid to flow through the nipple head when opposing walls of the nipple head are compressed to abut one another, such as when an infant bites on the nipple head.

According to another aspect, a feeding bottle includes a container, a one-piece nipple assembly, and a detachable bottom. The container may have tapered walls, a neck that is configured according to an offset angle, a container bottom, and a coupling channel near the container bottom. The nipple assembly may include a rigid ring substrate that is configured to couple to the neck of the container. The nipple assembly may also include a nipple head and a dome overmold, which are both pliable and have at least one texture. The dome overmold encompasses and is bonded to the rigid substrate. The detachable bottom may be a non-slip material and has a coupling ridge for coupling to coupling channel of the container.

According to yet another aspect, a method for providing a feeding bottle includes providing a ring substrate having a rigid or semi-rigid material and a nipple assembly thread. A nipple head and a dome overmold encompassing the ring substrate is also provided. The nipple head and the dome overmold are pliable and include an internal flow assist mechanism and a variable wall thickness that increases in thickness from the nipple head to the ring substrate. A container is provided that has tapered walls, a neck configured according to an offset angle, and a neck thread configured to couple with the nipple assembly thread of the ring substrate.

The features, functions, and advantages that have been discussed can be achieved independently in various embodiments of the present disclosure or may be combined in yet other embodiments, further details of which can be seen with reference to the following description and drawings.

DETAILED DESCRIPTION

Figure 1A:
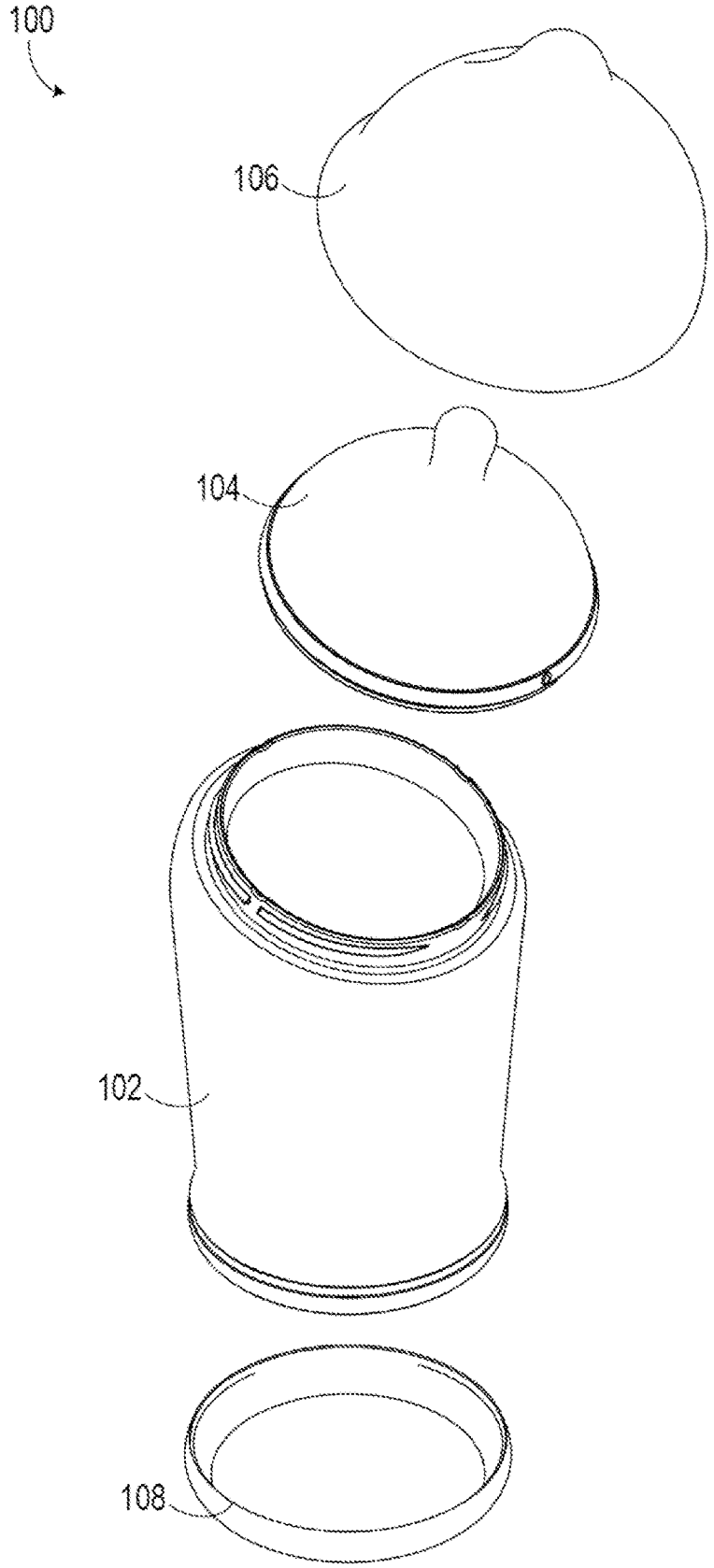
FIGS. 1A and 1B are top and bottom perspective views, respectively, of a disassembled feeding bottle according to various embodiments presented herein.

The following detailed description is directed to apparatus and methods for providing a feeding bottle that facilitates the feeding experience for both an infant and the care provider. As discussed briefly above, the transition from breastfeeding to bottle feeding can be frustrating for both the infant and the caregiver. Utilizing the concepts described herein, a feeding bottle includes a realistic nipple assembly that closely simulates the texture and feel of a human breast. In doing so, the infant is substantially more likely to correctly and quickly latch on to the bottle nipple. Other features of the feeding bottle according to various embodiments described below allows for a consistent flow of fluid, even when the infant is biting on the nipple. Still other features allow for simplified filling, closing, and holding the bottle by providing a wide, stable, and non-slip base.

As used throughout this disclosure, the term "infant" may apply to any person of any age that may drink fluid from a bottle. The term "fluid" may be used to refer to any type of liquid that may be transferred from the bottle container to the infant via the bottle nipple. In the following detailed description, references are made to the accompanying drawings that form a part hereof, and which are shown by way of illustration, specific embodiments, or examples. Referring now to the drawings, in which like numerals represent like elements through the several figures, the feeding bottle will be described.

Figure 1B:
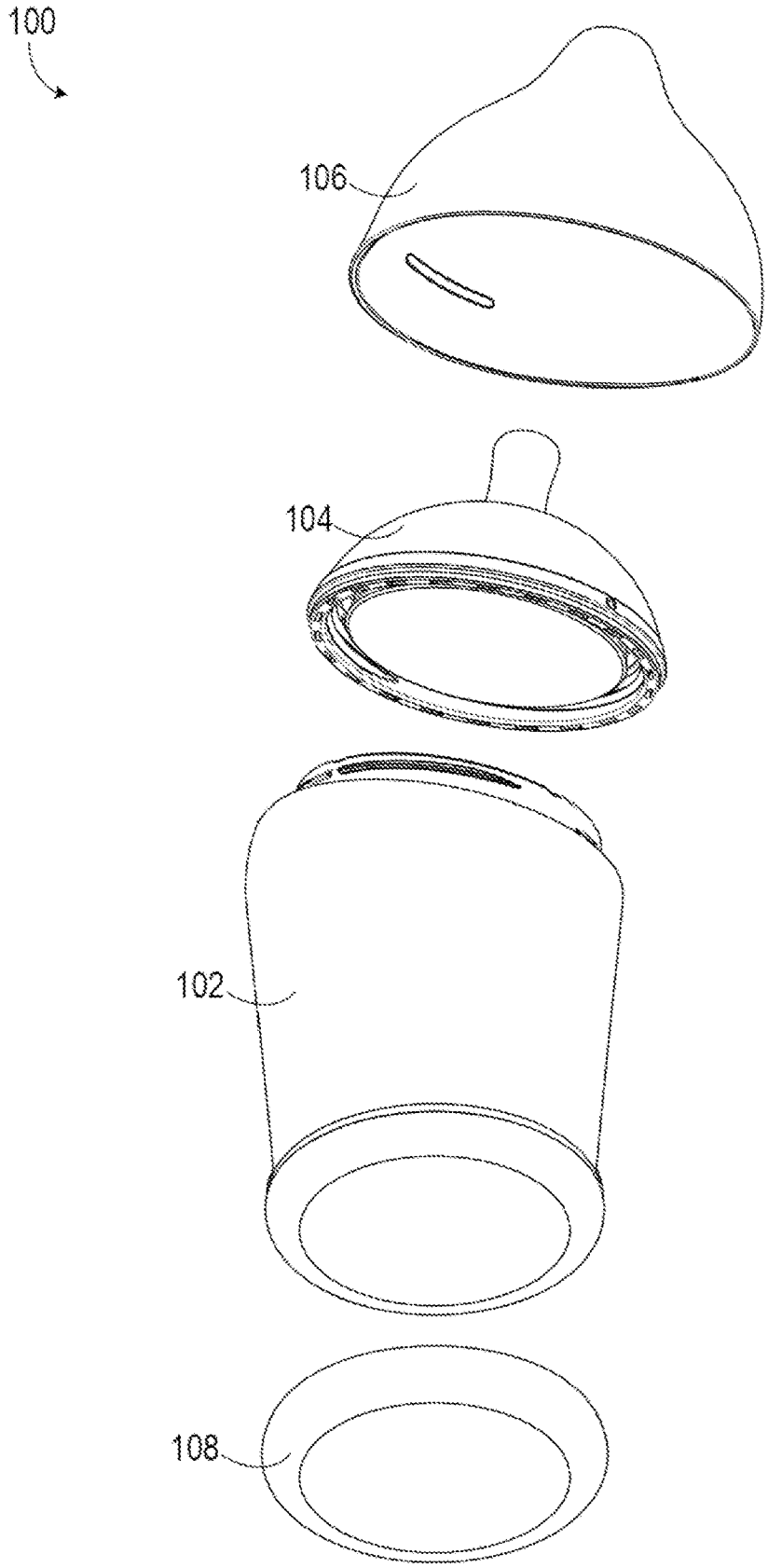

Turning to FIGS. 1A and 1B, cross-sectional and top views, respectively, of a feeding bottle 100 in a disassembled configuration is shown. According to this example, the feeding bottle 100 includes a container 102, a nipple assembly 104, a cover 106, and a detachable bottom 108. Each component of the feeding bottle 100 will be described in greater detail below. Generally, according to various embodiments, the container 102 may include an angled neck and a wide bottom that is flared outwards from the side walls of the container near the bottom. The detachable bottom 108 is manufactured from a non-slip material that prevents the feeding bottle 100 from sliding or turning on a typical counter or table. The nipple assembly 104 may be a one-piece device that includes a rigid ring substrate with a silicone or other pliable material overmolded onto the rigid ring substrate. The nipple assembly 104 may have multiple textures molded onto the outside surface of the dome overmold to realistically simulate a human breast. The cover 106 snaps into place over the nipple assembly 104 to prevent contamination of the nipple assembly 104 and to prevent leakage of the fluid from the nipple assembly 104.

Figure 2:
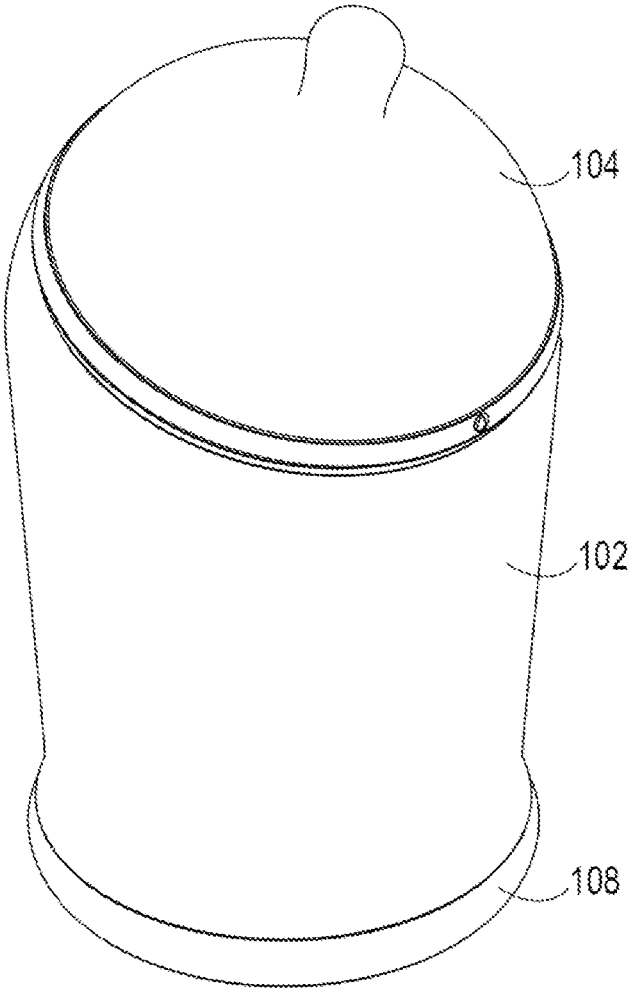
FIG. 2 is a top perspective view of an assembled feeding bottle without a cover according to various embodiments presented herein.

FIG. 2 shows one embodiment of the feeding bottle 100 in an assembled configuration without the cover 106. When assembled, the feeding bottle 100 provides a blended seam between the container 102 and the nipple assembly 104 to create a smooth transition between the two components. The shape of the container 102 and nipple assembly 104 provide a relatively wide semi-spherical feeding portion of the feeding bottle 100 that more closely resembles a human breast than that of conventional baby bottles.

As will be discussed in greater detail below, the nipple assembly 104 may have a texture gradient that changes from the end of the nipple to the base of the nipple assembly 104 proximate to the container 102. The texture of the nipple assembly 104 is yet another feature of the feeding bottle 100 that mimics a human breast to promote proper latching and to ease a child's transition from breastfeeding to bottle feeding. In addition, the nipple assembly 104 is a one-piece assembly that includes a rigid or semi-rigid locking ring configured to thread the nipple assembly 104 onto the container 102, and a silicone or otherwise pliable material overmolded onto the locking ring, creating an easy to use and easy to clean one-piece assembly.

As seen in FIG. 2 and discussed in greater detail below with respect to FIG. 3A, the container 102 has a shape that offers advantages over that of traditional baby bottles. Specifically, the container walls may not be parallel as they extend from the bottom of the bottle to the neck of the bottle. According to various embodiments, the walls of the container 102 may taper (or be substantially parallel) from the neck of the bottle down to a location proximate to the bottom. At this location proximate to the bottom, the walls may flare outwards to create a wide base that prevents the feeding bottle 100 from slipping out of a caregiver's hand and creates a stable platform on which the feeding bottle 100 rests.

The detachable bottom 108 snaps into place as described below and may be manufactured from a non-slip material such as a thermoplastic elastomer, silicone, or the like. The non-slip material provides a source of frictional engagement with a surface on which the feeding bottle 100 is placed so that the caregiver can thread the nipple assembly 104 onto the container 102, fill the container 102, and clean the container 102 while the feeding bottle 100 remains in place and secure from slipping. This feature is advantageous when filling, using, or cleaning the feeding bottle 100 with one hand while holding the infant or being otherwise engaged with the other hand. According to various embodiments, the detachable bottom 108 may be manufactured in multiple colors. Because the detachable bottom 108 is easily removed and replaced on any container 102, the bottoms may be color coded and used to identify a particular child, a particular fluid, and/or a particular day or time that the feeding bottle 100 was filled or is to be consumed.

Figure 3A:
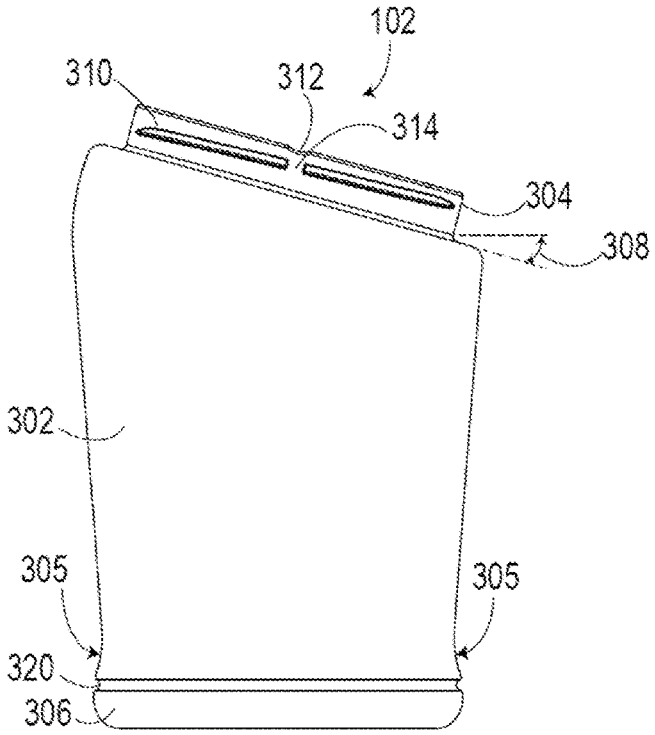
FIGS. 3A-3C are side, front, and top views, respectively, of a container according to various embodiments presented herein.
Figure 3B:
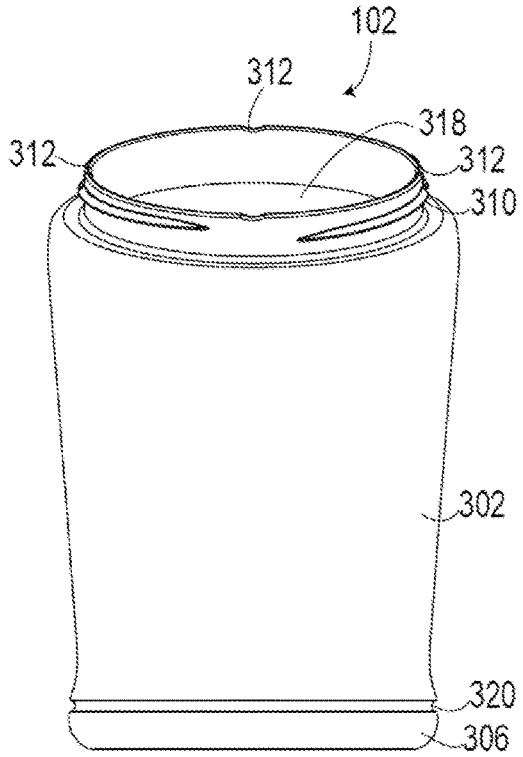
Figure 3C:
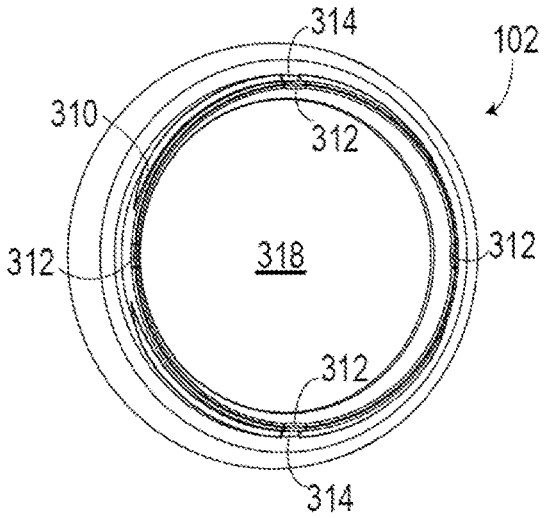

Referring now to FIGS. 3A-3C, aspects of the container 102 will now be discussed according to various embodiments. As previously stated, the container 102 includes walls 302. These walls 302 may be formed so as to create a unique shape that tapers inward, uniformly or non-uniformly, from a top portion of the container 102 to a position proximate to the container bottom 306. At this position proximate to the container bottom 306, the walls may broaden or flare outward to create a non-slip broadening 305 that prevents a caregiver's hand from slipping off the bottom of the feeding bottle 100 when holding the bottle in a substantially inverted or downward tilting manner during feeding.

The container 102 includes a neck 304 to which the nipple assembly 104 is coupled. The neck 304 defines a fill aperture 318 through which the interior of the feeding bottle 100 may be filled with fluid. According to one embodiment, the neck 304 is configured at an offset angle 308 from horizontal that effectively tilts or angles the nipple assembly 104 with respect to the container 102. The offset angle 308 of the nipple assembly 104 provides a more natural and/or comfortable hand position for the caregiver when feeding an infant with the feeding bottle 100. For example, due to the offset angle 308, a caregiver may be able to rest his or her hand lightly on the infant's torso or on the caregiver's own body while holding the infant and the feeding bottle 100 in position for feeding. The feeding bottle 100 will be angled at a lower position during feeding than if the offset angle 308 did not exist, increasing the comfort of the caregiver and allowing for an unobstructed view of the infant during feeding. An example range of offset angles 308 includes, but is not limited to, 10 degrees to 25 degrees from horizontal, such as a 15 degree offset angle 308.

The neck 304 includes neck threads 310 for coupling the container 102 to a nipple assembly 104 via corresponding threads on the nipple assembly 104. According to one embodiment, the neck threads 310 include a short pitch that allows the nipple assembly 104 to be screwed on or off with an approximate 120 degree rotation. Multiple vent notches 312 are positioned around the circumference of the neck 304. According to the example shown, there are four vent notches 312 molded into the neck 304, but it should be appreciated that a greater or fewer number of vent notches 312 may be used. In addition to the vent notches 312, there may be corresponding thread vents 314 that interrupt the neck threads 310 at appropriate positions proximate to the vent notches 312. The vent notches 312 and the thread vents 314 allow for the flow of air in and out of the feeding bottle 100 to equalize the pressure inside the container 102 and maintain adequate fluid flow through the nipple assembly 104. It should be appreciated that the size, shape, positioning, and quantity of the vent notches 312 and the thread vents 314 may be altered from what is shown in the various figures without departing from the scope of this disclosure. As one example, the vent notches 312 may be configured as apertures within the neck 304 instead of notches or depressions in the top edge of the neck 304. The venting process will be described in further detail below when discussing the nipple venting membrane of the nipple assembly 104.

According to one embodiment, the container 102 includes a coupling channel 320 proximate to the container bottom 306. The coupling channel 320 may be created during the molding process and may be configured as a continuous channel around the circumference of the container 102. Alternatively, the coupling channel 320 may be configured as two or more depressions positioned on opposing sides of the container 102. The coupling channel 320 provides a means for attaching the detachable bottom 108 or any other accessory.

Figure 6:
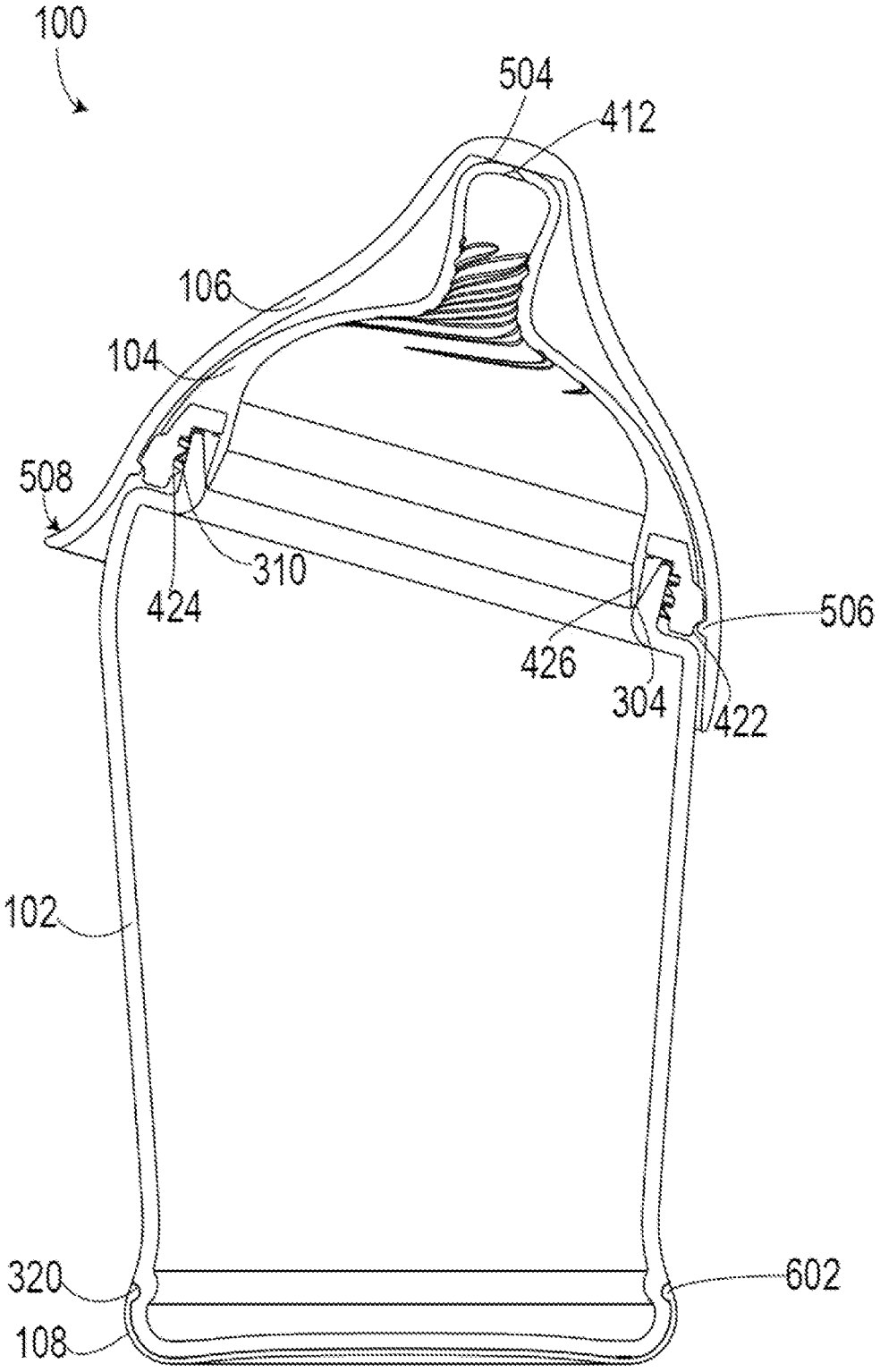
FIG. 6 is a cross-sectional view of an assembled feeding bottle without a cover according to various embodiments presented herein.

Turning briefly to FIG. 6, the coupling of the detachable bottom 108 to the container 102 will be illustrated and described. The detachable bottom 108 may include a coupling ridge 602 that projects from an interior surface of the detachable bottom 108 and is positioned to engage the coupling channel 320 of the container 102. The coupling ridge 602 may be created during the molding process and may be configured as a continuous ridge around the circumference of the interior surface of the detachable bottom 108. Alternatively, the coupling ridge 602 may be configured as two or more projections positioned on opposing sides of the interior surface of the detachable bottom 108. When the detachable bottom 108 is positioned against the container bottom 306 and pressure is applied, the pliable material of the detachable bottom 108 allows the detachable bottom 108 to flex outward until the coupling ridge 602 engages and seats within the coupling channel 320 of the container 102. In this manner, any detachable bottom 108 may be snapped on and off of any container 102 at will.

The container 102 may be manufactured from clear rigid Grilamid Nylon or other suitable material. The container 102 may be sized to accommodate any volume of fluid. According to two illustrative examples, the container 102 may be manufactured in two sizes corresponding to a larger 240 ml volume and a smaller 120 ml volume. The nipple assembly 104, cover 106, and detachable bottom 108 are universal in that they are interchangeable between all containers 102 of all volumes.

Turning to FIGS. 4A-4D, features of the nipple assembly 104 will now be described. According to various embodiments, the nipple assembly 104 includes a one-piece design having a ring substrate 406 encompassed by a dome overmold 402. As mentioned above, conventional bottle nipple assemblies include two separate pieces, a rigid threaded ring piece used to secure a rubber or other pliable nipple portion to the container. The two-piece nipple design requires assembly when coupling the nipple to the bottle, as well as disassembly and separate cleaning of the parts after decoupling the nipple from the bottle.

In contrast, the embodiments described herein provide a one-piece nipple assembly that simplifies coupling and decoupling the nipple assembly 104 to and from the container 102, as well as simplifying cleaning. The ring substrate 406 may be manufactured from any material having a rigid or semi-rigid characteristic that is suitable for use within a food container. An example includes, but is not limited to, a talc, glass, or mineral fiber reinforced plastic. The ring substrate 406 includes nipple assembly threads 424 configured for coupling to the neck threads 310 on the container 102. The ring substrate 406 may additionally include a flow rate indicator 410 that notifies the user as to the fluid flow rate associated with the particular nipple assembly 104. Alternatively, the flow rate indicator 410 may be incorporated into the dome overmold 402 discussed below. The ring substrate 406 includes a cover locking undercut 422, which is a recessed portion of the ring substrate proximate to the container 102 when the nipple assembly 104 is coupled to the container 102. This cover locking undercut 422 is configured to engage a corresponding feature of the cover 106 to couple and decouple the cover 106 onto the nipple assembly 104 as described below with respect to FIGS. 5A-6. Finally, the ring substrate 406 may include any number of one dimensional locking part removal mechanisms 428 used to remove the ring substrate 406 from the tool after manufacturing.

The ring substrate 406 is encompassed by a dome overmold 402 with nipple head 404. The dome overmold 402 may be manufactured from silicone, thermoplastic rubber, thermoplastic elastomer, or other suitable material having a pliable characteristic. The dome overmold 402 with the nipple head 404 is created around the ring substrate 406 so that the two materials are bonded together, creating a one-piece nipple assembly 104. The dome overmold 402 and nipple head 404 may include multiple textures 408A-408C (collectively referred to as "texture(s) 408"). In the example shown in FIG. 4A, the dome overmold 402 and nipple head 404 includes three textures 402A, 402B, and 402C. These textures may be molded into the silicone or other material in a manner that provides a seamless texture gradient from the nipple head 404 to the base of the dome overmold 402 near the ring substrate 406.

As an example, the nipple head 404 may include a texture 408C having a roughness average (RA) of approximately 2.0 micrometers, the base of the dome overmold 402 may include a texture 408A having a RA of approximately 5.0 micrometers, and the main body portion of the dome overmold 402 may include a texture 408B that is approximately between 2.0-5.0 micrometers. The textures 408A-408C may transition between one another smoothly, offering a seamless texture gradient throughout the surface of the nipple assembly 104. The textures 408 provide the nipple assembly 104 with a uniquely realistic look and feel of skin in order to better simulate the human breast and provide tactile feedback to the infant to promote infant latching and feeding.

Another feature of the nipple assembly 104 that enhances the realism associated with the look and feel of the nipple head 404 and dome overmold 402 is the variable wall thickness of the silicone or other material of the nipple assembly 104. As seen in the cross-sectional view of the nipple assembly 104 shown in FIG. 4B, the dome overmold 402 has an upper thickness 420 and a base thickness 418.

According to one embodiment, the thickness of the silicone or other material of the dome overmold 402 progressively increases from the upper thickness 420 near the nipple head 404 that is relatively thin to the base thickness 418 near the ring substrate 406 that is substantially thicker than the upper thickness 420. By varying the thickness, and specifically increasing the thickness from the nipple head 404 to the ring substrate 406, the nipple head 404 and surrounding area is the softest and most pliable portion of the nipple assembly 104, while the base of the nipple assembly 104 near the rigid ring substrate 406 is the firmest portion of the nipple assembly 104. Again adding to the realism of the nipple assembly 104, this transition between the upper thickness 420 and the base thickness 418 may be a gradual seamless transition made possible in part due to the overmolding process in which the silicone or other material of the dome overmold 402 is molded around the ring substrate 406.

Figure 4A:
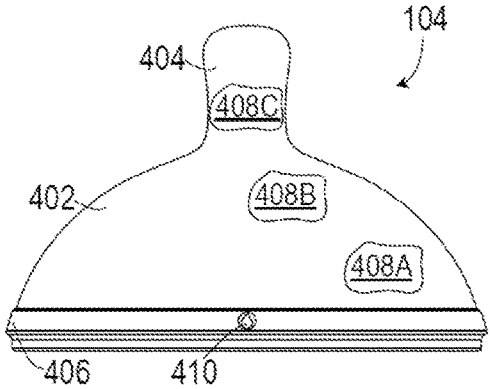
FIGS. 4A-4C are side, cross-sectional, and top views, respectively, of a nipple assembly according to various embodiments presented herein.
Figure 4B:
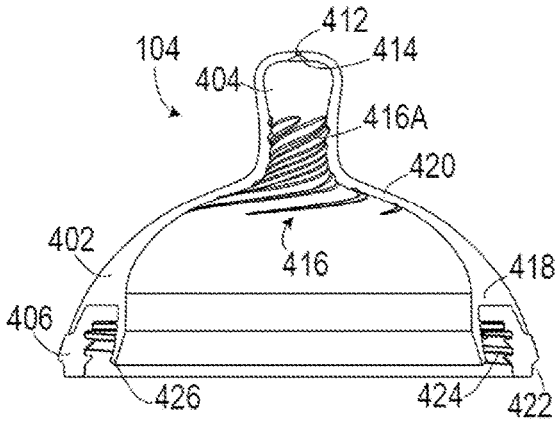

As seen in FIG. 4B, the dome overmold 402 extends to the inside of the nipple assembly threads 424 to create a nipple venting membrane 426. Referring briefly to FIG. 6, the nipple venting membrane 426 can be seen resting against the inside surface of the neck 304 when the nipple assembly 104 is threaded onto the container 102. As a vacuum or negative air pressure is created inside the feeding bottle 100 during feeding, external air is pulled through the thread vents 312 and vent notches 312, and into the container 102 between the nipple venting membrane 426 and the neck 304 as the nipple venting membrane 426 flexes inward away from the neck 304. When air is not being pulled into the feeding bottle 100, the nipple venting membrane 426 is biased to press against the inside surface of the neck 304 to prevent fluid from escaping, creating a one-way valve mechanism.

Figure 4C:
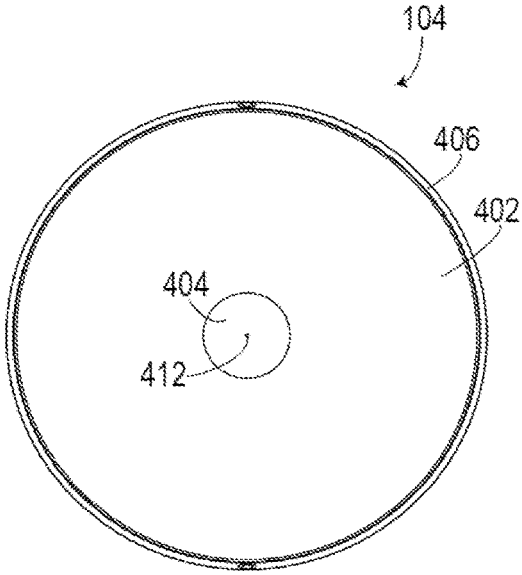

Returning to the cross-sectional and top views of FIGS. 4B and 4C, respectively, the nipple assembly 104 includes a drinking pinhole 412 and a drinking pinhole cone 414 positioned at the tip of the nipple head 404. The drinking pinhole 412 and drinking pinhole cone 414 provide a means for transferring fluid from the container 102 to the infant during feeding. It should be appreciated that the drinking pinhole 412 may be sized according to the desired fluid flow rate, and may include more than one drinking pinholes.

According to various embodiments, the nipple assembly 104 includes an internal flow assist mechanism 416 that is molded or otherwise incorporated into an inside surface of the nipple head 404 and dome overmold 402. The internal flow assist mechanism 416 provides multiple benefits. First, the internal flow assist mechanism 416 assists the flow of fluid through the nipple head 404, even when the infant is biting or pulling on the nipple head 404. With a conventional nipple head, when the infant bites or pulls, opposing sides of the nipple head 404 are pressed together, which closes off the passage between the container 102 and the drinking pinhole 412 and prevents the infant from feeding.

However, utilizing the nipple assembly 104 of the various embodiments described herein, the internal flow assist mechanism 416 provides fluid passageways through the nipple head 404 when the opposing walls of the nipple head 404 are compressed to abut one another when biting or pulling. According to one embodiment, the internal flow assist mechanism 416 may be created by molding the nipple assembly 104 with channels or indentations within the inside surface of the nipple head 404 and dome overmold 402 according to the desired pattern. According to an alternative embodiment, the internal flow assist mechanism 416 may be created by molding the nipple assembly 104 with additional material (i.e., ribs or projections) projecting outward from the inside surface of the nipple head 404 and dome overmold 402 according to the desired pattern.

Another benefit of the internal flow assist mechanism 416 is to provide strength and/or resiliency in the nipple head 404. Depending on the pattern of the internal flow assist mechanism 416, the particular pattern may strengthen the nipple head 404, particularly when the internal flow assist mechanism 416 is manufactured by molding the nipple assembly 104 with additional material projecting outward from the inside surface of the nipple head 404 and dome overmold 402 according to the desired pattern. Additionally, the pattern of the internal flow assist mechanism 416 may provide a resiliency that assists in returning a pulled nipple head 404 to an original position. For example, a vortex pattern 416A as shown in FIGS. 4B and 4D may act as a spring, resisting a pulling action when an infant pulls the nipple head 404 in a direction away from the dome overmold 402.

Figure 4D:
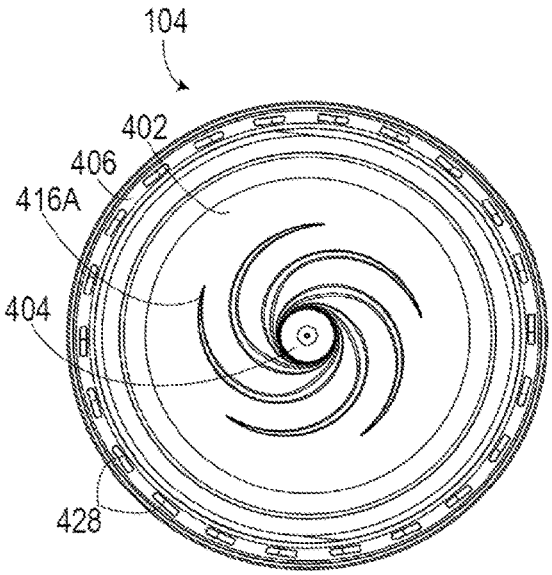
FIGS. 4D-4H are bottom views of a nipple assembly showing various flow support devices according to various embodiments presented herein.
Figure 4E:
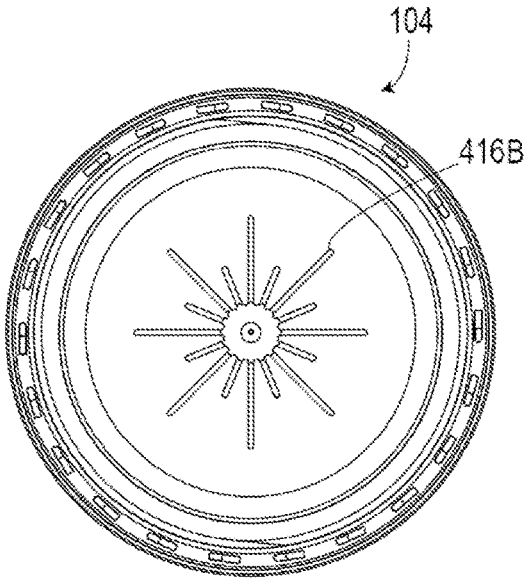
Figure 4F:
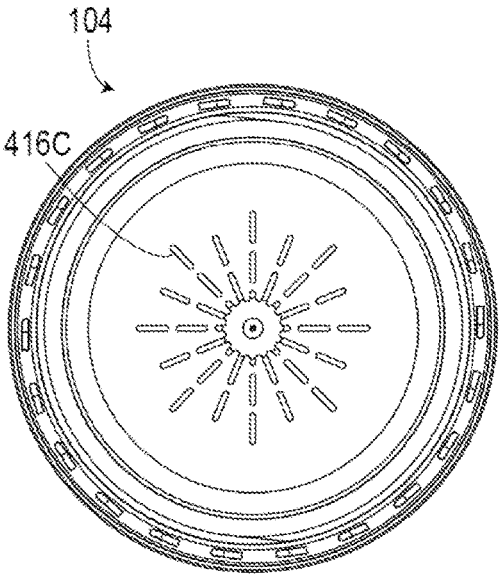

FIGS. 4D-4H depict bottom views of a nipple assembly 104, illustrating various pattern examples of internal flow assist mechanisms 416 according to various embodiments. It should be understood that the internal flow assist mechanism 416 of the disclosure herein is not limited to the example patterns shown in FIGS. 4D-4H. FIG. 4D shows the vortex pattern 416A described above in which repeated arcuate mechanisms are arranged in a vortex pattern around the neck head 404 and upper portion of the dome overmold 402. The term "mechanisms" will be used to describe both channels and projections according to the alternative embodiments discussed above. FIG. 4E shows a connected starburst pattern 416B. With this pattern, repeated linear mechanisms encircle the neck head 404. FIG. 4F shows a disconnected starburst pattern 416C, which is similar to the connected starburst pattern 416B, but the linear mechanisms are broken rather than continuous.

Figure 4G:
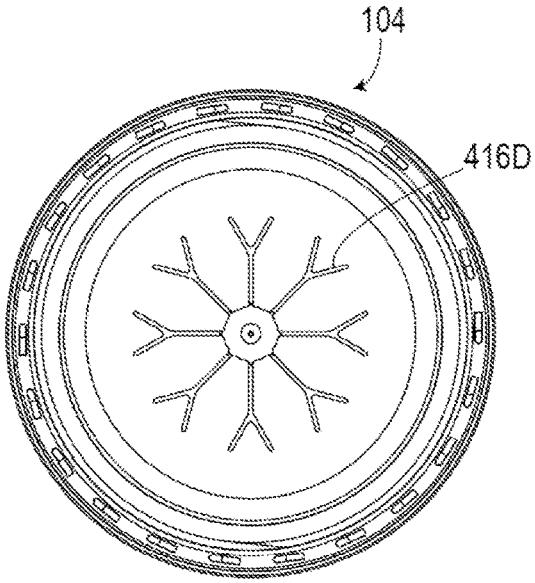
Figure 4H:
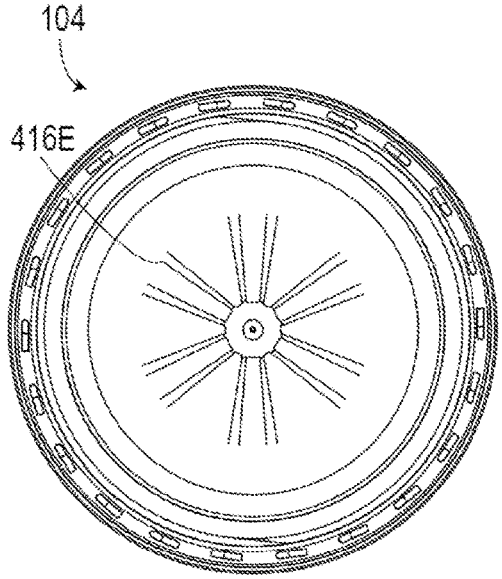

FIG. 4G shows a snowflake pattern 416D. With this pattern, repeated linear mechanisms encircle the neck head 404, with each mechanism forking at a distal end opposite the neck head 404. FIG. 4H shows a sunrise pattern 416E in which sets of two pairs of linear mechanisms encircle the neck head 404. Each pair of linear mechanisms diverges at the distal end opposite the neck head 404. As stated above, the internal flow assist mechanism 416 patterns shown in FIGS. 4D-4H are merely examples and are not considered to be limiting.

Figure 5A:
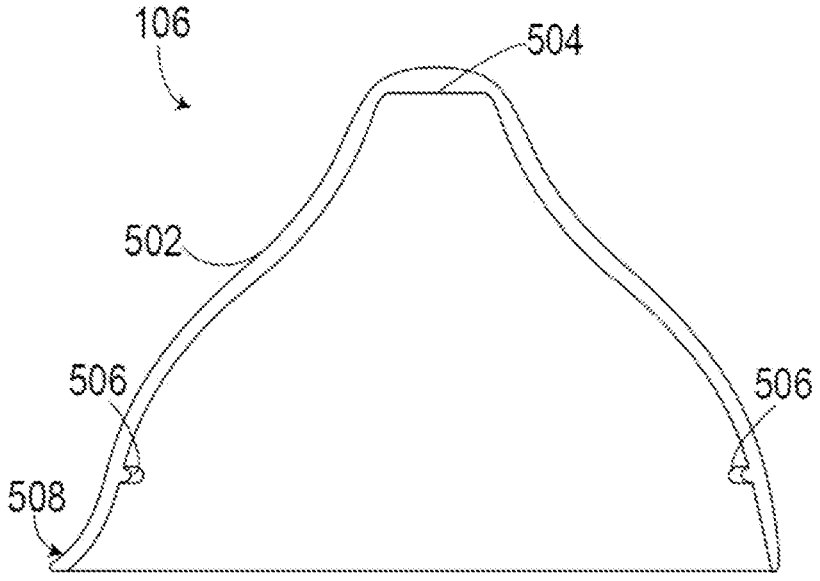
FIGS. 5A and 5B are cross-sectional and bottom views, respectively, of a cover according to various embodiments presented herein.
Figure 5B:
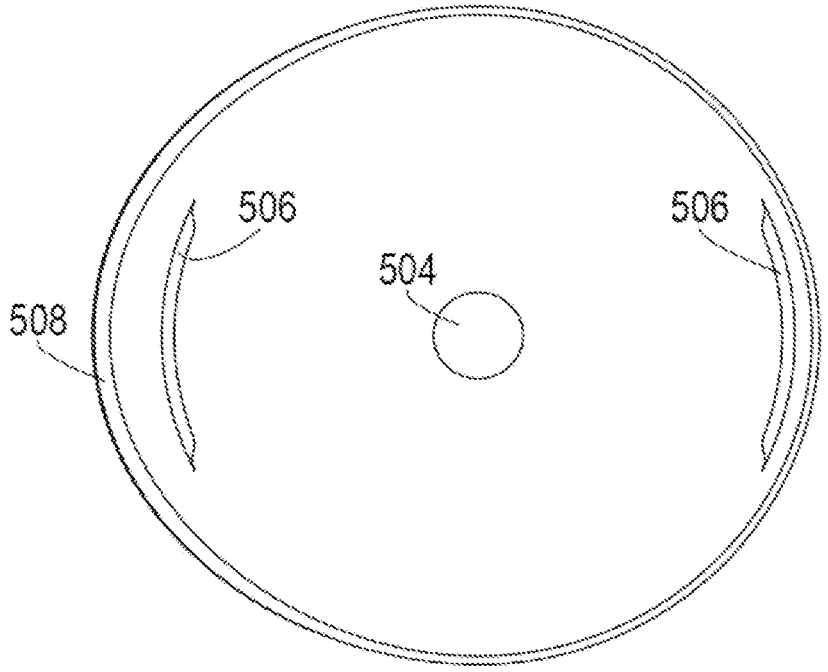

Turning to FIGS. 5A and 5B, the cover 106 will be described according to one embodiment. The cover 106 may be manufactured from a polypropylene, thermoplastic elastomer or other suitable rigid material. The cover 106 includes an outer surface 502 that substantially follows the contour of the nipple assembly 104, which reduces the storage volume of the feeding bottle 100 as compared to conventional bottles having squared off caps with large flat surfaces on top. A nipple compressing surface 504 on the inside of the cover 106 pushes down on the drinking pinhole 412 of the nipple assembly 104 when installed on the feeding bottle 100. In doing so, the drinking pinhole 412 is sealed, preventing fluid from leaking out of the nipple assembly 104 if the feeding bottle 100 is overturned.

The cover 106 has a cover coupling ridge 506 that projects from an interior surface of the cover 106 and is positioned to engage the cover locking undercut 422 of the ring substrate 406. The cover coupling ridge 506 may be created during the molding process and may be configured as a continuous ridge around the circumference of the interior surface of the cover 106. Alternatively, the cover coupling ridge 506 may be configured as two or more projections positioned on opposing sides of the interior surface of the cover 106, as shown in FIG. 5B. When the cover 106 is positioned against the nipple assembly 104 and pressure is applied, the cover coupling ridge 506 engages and seats within the cover locking undercut 422 of the ring substrate 406. In this manner, any cover 106 may be snapped on and off of any nipple assembly 104 at will.

The cover 106 additionally may include a cover removal widening 508 that allows for the cover 106 to be easily snapped off using a thumb or finger of one hand. The cover removal widening 508 is a flaring of the cover material in one location. This flaring at one location which projects the cover 106 away from the feeding bottle 100 enough to allow the cover 106 to be easily pushed upward and off of the nipple assembly 104 from below at that location. The cover removal widening 508 is more easily seen in FIG. 6.

FIG. 6 illustrates a cross-section of an assembled feeding bottle 100. From this view, the interaction of various features of the various components described above can be seen. For example, the engagement of the nipple assembly threads 424 and the neck threads 310 can be seen, with the nipple venting membrane 426 resting against the inside surface of the neck 304. Additionally, the engagement of the nipple compressing surface 504 against the drinking pinhole 412 is shown. Finally, the engagement of the coupling ridge 602 that projects from an interior surface of the detachable bottom 108 with the coupling channel 320 of the container 102 is shown.

Figure 7:
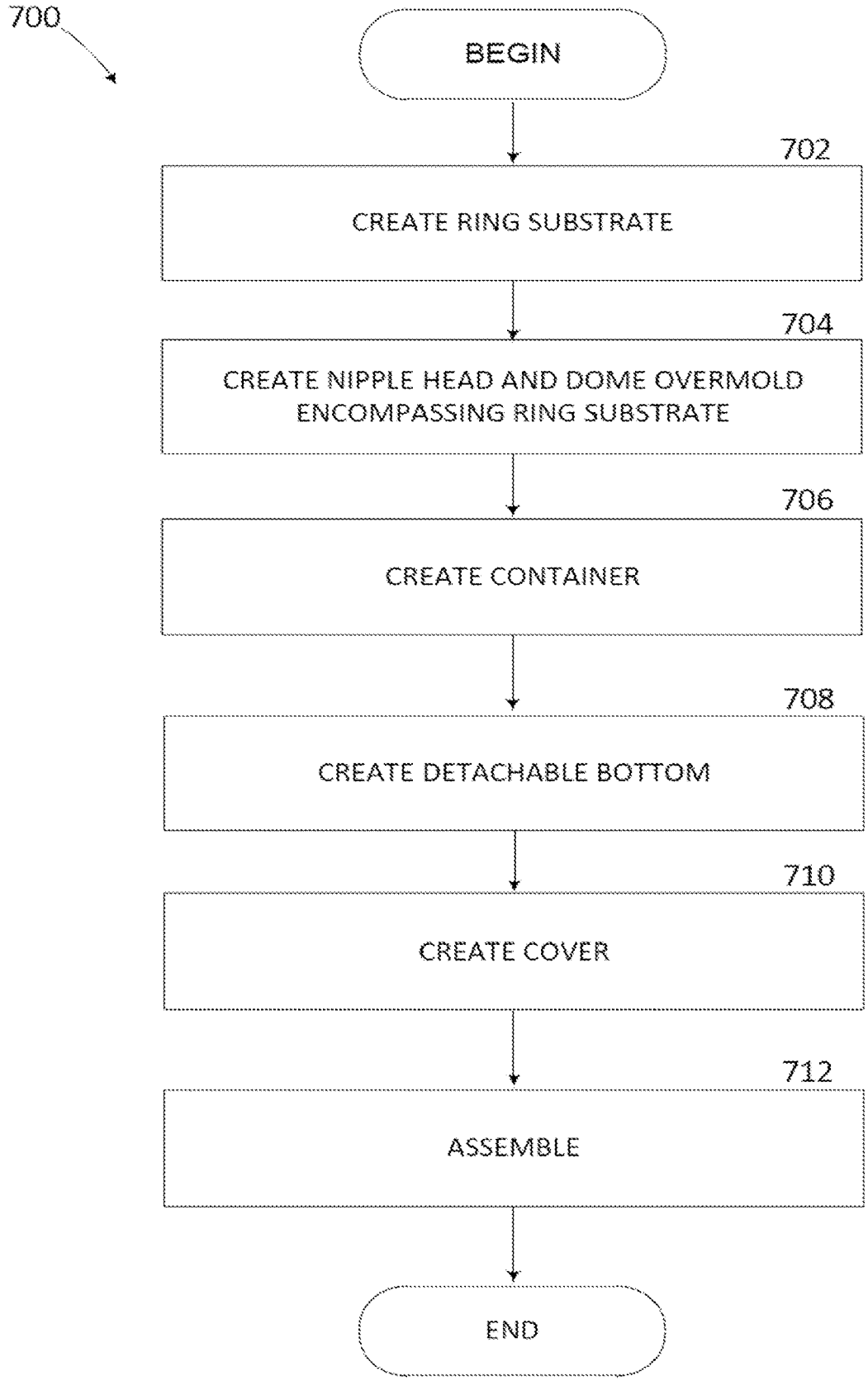
FIG. 7 is a process flow diagram illustrating a method for providing a feeding bottle according to various embodiments presented herein.

Turning now to FIG. 7, an illustrative routine 700 for providing a feeding bottle 100 will now be described in detail. It should be appreciated that more or fewer operations may be performed than shown in the figures and described herein. These operations may also be performed in a different order than those described herein.

The routine 700 begins at operation 702, where the ring substrate 406 is created. As discussed above, the ring substrate 406 may be manufactured from a talc, glass, or mineral fiber reinforced plastic or any other suitable rigid or semi-rigid material. The ring substrate 406 may be created in the desired shape and size using injection molding or other known molding techniques. According to various embodiments, the ring substrate 406 may include the nipple assembly threads 424, a flow rate indicator 410, the cover locking undercut 422, and any number of one dimensional locking part removal mechanisms 428 used to remove the ring substrate 406 from the tool after manufacturing.

From operation 702, the routine 700 continues to operation 704, where the nipple head 404 and dome overmold 402 are formed around the ring substrate 406 to create a one-piece nipple assembly 104. The nipple head 404 and dome overmold 402 may be manufactured from silicone or other suitable pliable material. The material for the nipple head 404 and dome overmold 402 may be injection molded into a mold that includes the ring substrate 406 so that, when cured, the dome overmold 402 bonds to the ring substrate 406. The mold used for the nipple assembly 104 may include the desired textures 408 and produce the variable wall thicknesses described above. The mold may additionally be formed to create the nipple venting membrane 426.

The routine 700 continues from operation 704 to operation 706, where the container 102 is created using injection stretch blow molding or other known techniques. The container 102 may include tapering walls, a neck 304 having the desired offset angle 308, the neck threads 310, a non-slip broadening 305, and the coupling channel 320. From operation 706, the routine 700 continues to operation 708, where the detachable bottom 108 is created. The detachable bottom 108 may be manufactured from thermoplastic elastomer, silicone, or other suitable non-slip material in any desired color. The material of the detachable bottom 108 may be molded to include the coupling ridge 602 to allow the detachable bottom 108 to be snapped on and off of the container bottom 306.

At operation 710, the cover 106 is created using a polypropylene, thermoplastic elastomer or other suitable rigid material and known molding techniques. The cover 106 may include an outer surface 502 that substantially follows the contour of the nipple assembly 104, a nipple compressing surface 504 on the inside of the cover 106, a cover coupling ridge 506 that projects from an interior surface of the cover 106, and a cover removal widening 508 as described above. At operation 712, the nipple assembly 104 may be threaded onto the container 102 and the detachable bottom 108 and the cover 106 snapped into place to produce the assembled feeding bottle 100, and the routine 700 ends.

Based on the foregoing, it should be appreciated that technologies for providing a feeding bottle have been presented herein. The subject matter described above is provided by way of illustration only and should not be construed as limiting. Various modifications and changes may be made to the subject matter described herein without following the example embodiments and applications illustrated and described, and without departing from the true spirit and scope of the present disclosure, which is set forth in the following claims.

What is claimed is:

1. A feeding bottle, comprising: a cover comprising:

an outer surface that substantially follows a contour of the one-piece nipple assembly: a nipple compressing surface on an inside of the cover that is configured to push down on a drinking pinhole of the nipple head when the cover coupling ridge of the cover is engaged with the cover locking undercut of the ring substrate: and a cover removal widening having a flaring of the cover material in one location and configured to project a portion of the cover away from the container to allow the cover to be easily pushed upward and off of the one-piece nipple assembly:

a container comprising a neck thread and a plurality of tapered walls; and a one-piece nipple assembly, comprising:

a ring substrate having a rigid characteristic and configured to couple to the container, the ring substrate comprising a nipple assembly thread having a short pitch configured to couple to the neck thread to couple the one-piece nipple assembly to the container, and a cover locking undercut configured to engage a cover coupling ridge of the cover to secure the cover over the nipple head and a dome overmold, a nipple head and the dome overmold each having a pliable characteristic, wherein the dome overmold encompasses and is bonded to the ring substrate, wherein the dome overmold comprises a variable wall thickness increasing in thickness from the nipple head to the ring substrate, and wherein the dome overmold comprises a nipple venting membrane configured to abut the neck around an entire circumference of the neck when the one-piece nipple assembly is coupled to the container and to flex inward away from the neck to allow air to enter the container through the plurality of vent notches, wherein the nipple head and dome overmold comprises a texture gradient that increases in coarseness from the nipple head to a base of the dome overmold; and an internal liquid flow assist mechanism incorporated into an inside surface of the nipple head and the dome overmold and configured to allow liquid to flow through the nipple head when opposing walls of the nipple head are compressed to abut one another.

2. The feeding bottle of claim 1, wherein the container comprises:

the neck configured according to an offset angle;

a container bottom; and a coupling channel proximate to the container bottom.

3. The feeding bottle of claim 1, wherein the plurality of tapered walls taper from the neck down to a location proximate to the container bottom and broaden outward toward the container bottom to create a non-slip broadening.

4. The feeding bottle of claim 2, further comprising a detachable bottom having a coupling ridge configured to removably engage the coupling channel of the container, wherein the detachable bottom comprises a non-slip material.

5. The feeding bottle of claim 1, wherein the texture gradient that increases in coarseness from the nipple head to the base of the dome overmold is configured to mimic a human breast.

* * * * *